US006109976A

United States Patent [19]

van Zanten et al.

[11] Patent Number: 6,109,976

[45] Date of Patent: Aug. 29, 2000

[54] MODULAR HIGH SPEED CONNECTOR

[75] Inventors: Albertus van Zanten, 's-Hertogenbosch; Bernardus L. F. Paagman, Schijndel, both of Netherlands

[73] Assignee: Berg Technology, Inc., Reno, Nev.

[21] Appl. No.: 09/113,579

[22] Filed: Jul. 10, 1998

[51] Int. Cl.[7] ..... H01R 13/502

[52] U.S. Cl. ..... 439/689; 439/76.1; 439/942

[58] Field of Search ..... 439/689, 701, 439/79, 660, 620, 607, 608, 76.1

[56] References Cited

U.S. PATENT DOCUMENTS

| | | | |
|---|---|---|---|
| 3,035,244 | 5/1962 | Aveni . | |
| 3,208,028 | 9/1965 | Mittler et al. . | |
| 3,432,801 | 3/1969 | Ruotolo . | |
| 3,564,343 | 2/1971 | Guest et al. . | |
| 4,008,941 | 2/1977 | Smith . | |
| 4,017,770 | 4/1977 | Valfre | 361/399 |
| 4,148,543 | 4/1979 | Shores . | |
| 4,157,612 | 6/1979 | Rainal | 29/628 |
| 4,206,963 | 6/1980 | English et al. . | |
| 4,265,549 | 5/1981 | Cote | 400/124 |
| 4,382,653 | 5/1983 | Blanchard . | |
| 4,457,574 | 7/1984 | Walters . | |
| 4,477,022 | 10/1984 | Shuey et al. . | |
| 4,571,014 | 2/1986 | Robin et al. . | |
| 4,689,721 | 8/1987 | Damerow et al. | 361/388 |
| 4,806,107 | 2/1989 | Arnold et al. | 439/79 |
| 4,846,727 | 7/1989 | Glover et al. | 439/608 |
| 4,861,272 | 8/1989 | Clark | 439/79 |
| 4,975,084 | 12/1990 | Fedder et al. | 439/608 |
| 5,055,069 | 10/1991 | Townsend et al. | 439/608 |
| 5,066,236 | 11/1991 | Broeksteeg | 439/79 |
| 5,104,341 | 4/1992 | Gilissen et al. | 439/608 |
| 5,118,300 | 6/1992 | Zerreli | 439/79 |
| 5,383,095 | 1/1995 | Korsunsky et al. | 361/785 |
| 5,429,520 | 7/1995 | Morlion et al. | 439/108 |
| 5,454,738 | 10/1995 | Lim et al. | 439/676 |
| 5,470,244 | 11/1995 | Lim et al. | 439/189 |
| 5,522,727 | 6/1996 | Saito et al. | 439/65 |
| 5,605,477 | 2/1997 | Wu et al. | 439/620 |
| 5,924,899 | 7/1999 | Paagman | 439/701 |

FOREIGN PATENT DOCUMENTS

| | | | |
|---|---|---|---|
| 0 442 643 B1 | 2/1991 | European Pat. Off. | H01R 23/68 |
| 0 411 613 B1 | 11/1996 | European Pat. Off. | H01R 13/504 |

OTHER PUBLICATIONS

IBM Technical Disclosure Bulletin—Shielded In–Line Electrical Multiconnector vol. 10 No. 3 Aug. 1967.

*Primary Examiner*—Neil Abrams
*Assistant Examiner*—Eugene G. Byrd
*Attorney, Agent, or Firm*—Brian J. Hamilla; M. Richard Page

[57] ABSTRACT

Connectors are formed from insulative, terminal-carrying frames that are open on at least one major surface. The open major surfaces allows rapid insertion of contact terminals and attachment of wires to contact surfaces within the frame. The frame includes wire receiving openings and cavities for positioning wires within the frame. Electrical continuity between the wires and the terminals may be achieved directly or by a circuit substrate that has circuit traces for electrically connecting an attached wire to a connector terminal. High speed cable connectors can be made in an industrially effective manner by such structures.

18 Claims, 16 Drawing Sheets

MODULAR HIGH SPEED CONNECTOR

BACKGROUND OF THE INVENTION

1. Field of the Invention

This invention relates to electrical connectors. Specifically, it relates to high speed, modular cable connectors.

2. Brief Description of Prior Developments

U.S. patent application Ser. No. 08/974536 filed Nov. 19, 1997 (owned by the assignee of the present application and incorporated by reference herein) discloses high speed cable connectors having terminal carriers mounted on circuit substrates. These connectors are modular and provide high performance. However, there is a desire to maintain such performance but reduce manufacturing costs.

SUMMARY OF THE INVENTION

This invention relates to connectors having frames for retaining electrical terminals and providing cable receipt and attachment facilities. Terminals can be mounted in the frame from relatively large open sides. Similarly, cable attachment can take place through such relatively large open sides. The sides can be closed by circuit substrates that provide for interconnection of terminals with cable attachment points and/or with shields that overlie one or both sides of the frame.

DETAILED DESCRIPTION OF THE PREFERRED EMBODIMENTS

Figure 1:
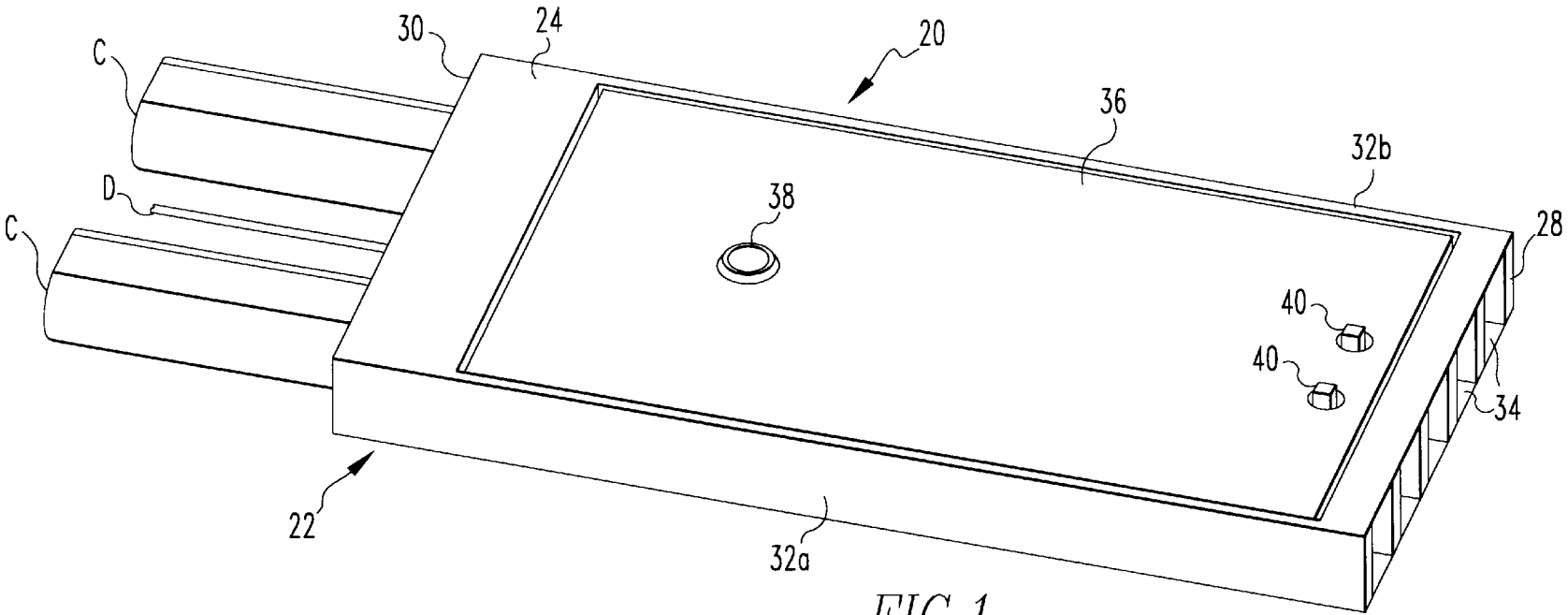
FIG. 1 is an isometric view of a first embodiment of a cable connector in accordance with the invention.

Several embodiments are explained in the following description. Similar elements in each embodiment are identified by the same reference numeral, differentiated between embodiments by the use of single or multiple prime designations.

Figure 4:
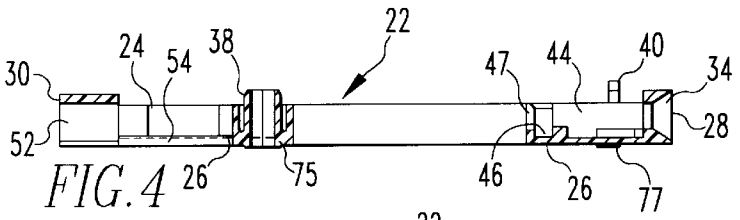
FIG. 4 is a side cross-sectional view taken along line 4—4 of FIG. 3.

FIG. 1 illustrates a cable connector module 20 embodying the invention. The module 20 is formed of an insulative or dielectric body 22 that has a generally frame-like configuration defined by two opposed major surfaces 24 and 26 (FIG. 4) that are joined by a front edge member 28, a back edge member 30 and a pair of side edge members 32*a* and 32*b*. The body 22 is preferably formed by molding a polymeric resin having appropriate strength and heat resistant characteristics. The front edge member 28 defines a mating interface for receiving terminals of a mating connector through a plurality of openings 34. For example, the module 20 could mate with one column of an array of terminal pins arranged in rows and columns in a pin header backplane connector, with such pins generally be inserted into the openings 34 in a direction parallel to the longitudinal axis of the module 20.

A circuit substrate 36, preferably a generally planar printed circuit board, is received on one of the major sides 24 of the frame 22. The circuit substrate 36 is retained and located with respect to the frame 22 by a securing/locating post 38 receivable in opening 39 (FIG. 2) and a pair of locating lugs 40 received in openings 41. The post 38 and lugs 40 can also function as stand-offs to achieve a desired terminal pitch distance between adjacent stacked modules 20, as later explained. The outer surface of the circuit substrate 36 is preferable coplanar with surrounding portions of the frame 22. If shielding is desirable, the substrate 36 may be of multi-layer construction, incorporating a ground plane.

Cables C, which may or may not be accompanied by an associated drain wire D are introduced into the interior of the frame 22 through the rear edge member 30. As shown, each of the cables C preferably comprises a two wire, differential pair conductor. Such cables may include shielding (not shown).

Referring to FIGS. 2–6, the frame 22 includes shoulder surfaces 42 along each of the side edge members 32*a* and 32*b*. The circuit substrate 36 rests on these shoulder surfaces as well as other surfaces within the frame that are coplanar with shoulder 42.

Figure 2:
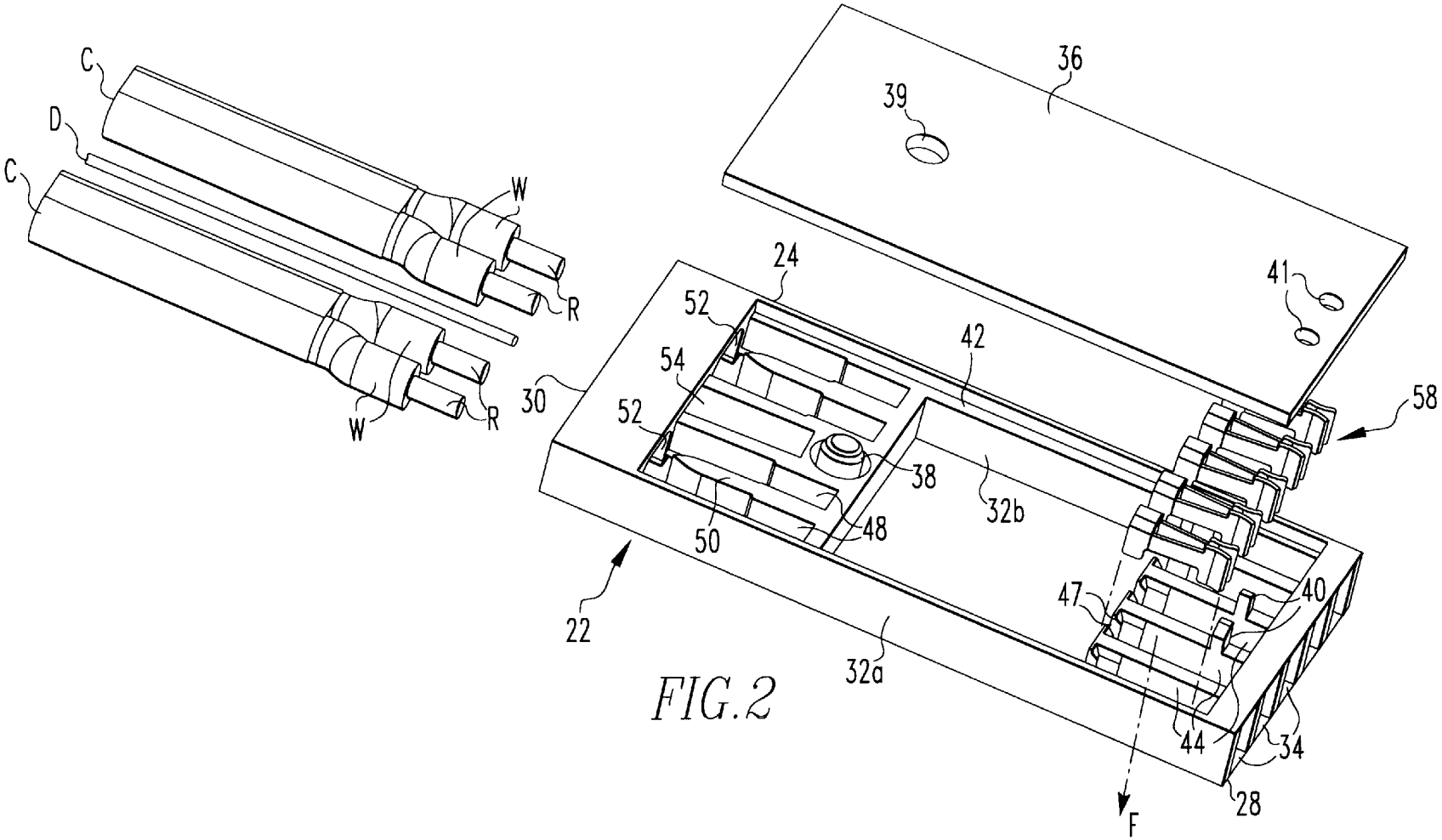
FIG. 2 is an exploded view of the connector shown in FIG. 1.
Figure 3:
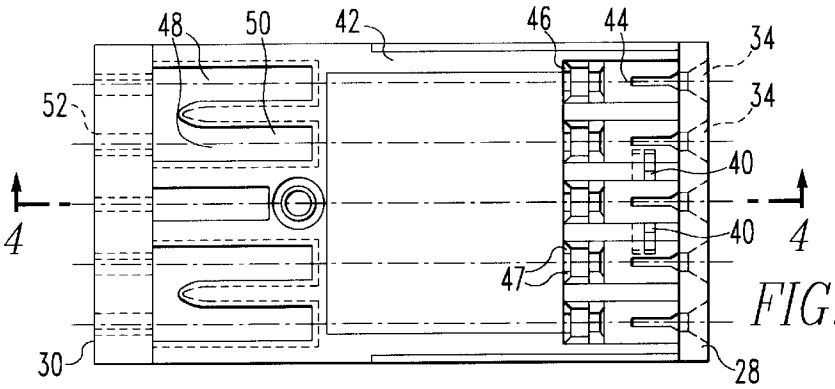
FIG. 3 is a top view of the frame of the connector shown in FIGS. 1 and 2.

A plurality of terminal receiving cavities 44 are formed along the front edge of the frame for receiving terminals 58 that are described below in more detail. Each of the cavities 44 is aligned with one of the openings 34 along the front edge member 28. Each cavity includes a terminal retention section such as a recess 46. The back ends of the cavity 44 are partially closed off by pairs of wall members 47. As illustrated in FIG. 2, the terminals 58 are inserted in the cavities 44 generally in the direction of arrow F. That is, generally in a direction that is perpendicular to the plane formed by the major surface 24.

Figure 5:
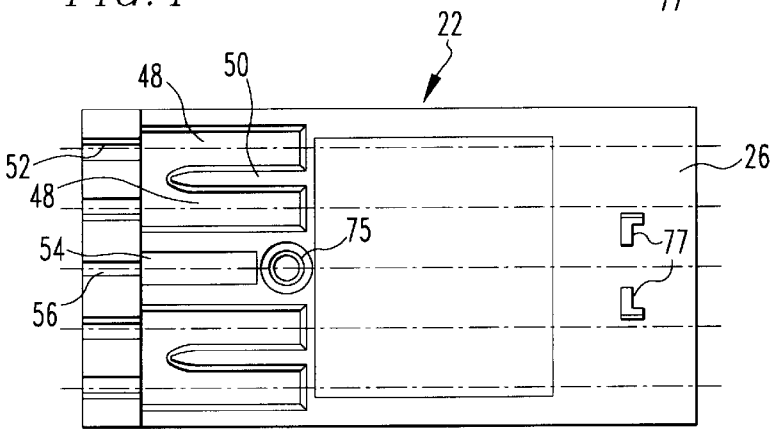
FIG. 5 is a plan view of the opposite side of the frame shown in FIG. 3.
Figure 6:
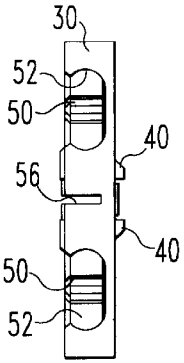
FIG. 6 is an end view taken from the left-hand side of FIG. 3.

A plurality of wire receiving cavities 48 are formed adjacent the rear edge member 30 of the frame 22. Dividing walls 50 form two cavities 48, one for each wire W of cables C. The cavities 48 communicate with cable entry openings 52 formed through the end member 30. If a drain wire D is present, the frame 22 will also include a drain wire cavity 54. The drain wire D enters the cavity 54 through a drain wire slot 56 (FIG. 5). When the circuit substrate 36 is mounted on the frame 22, access to wires W can be obtained from major surface 26 to secure the wires W onto the circuit substrate 36, as by soldering, welding, conductive adhesives or other means commonly used for obtaining electrical continuity between wires W and appropriate contact pads of circuit substrate 36.

Figure 7:
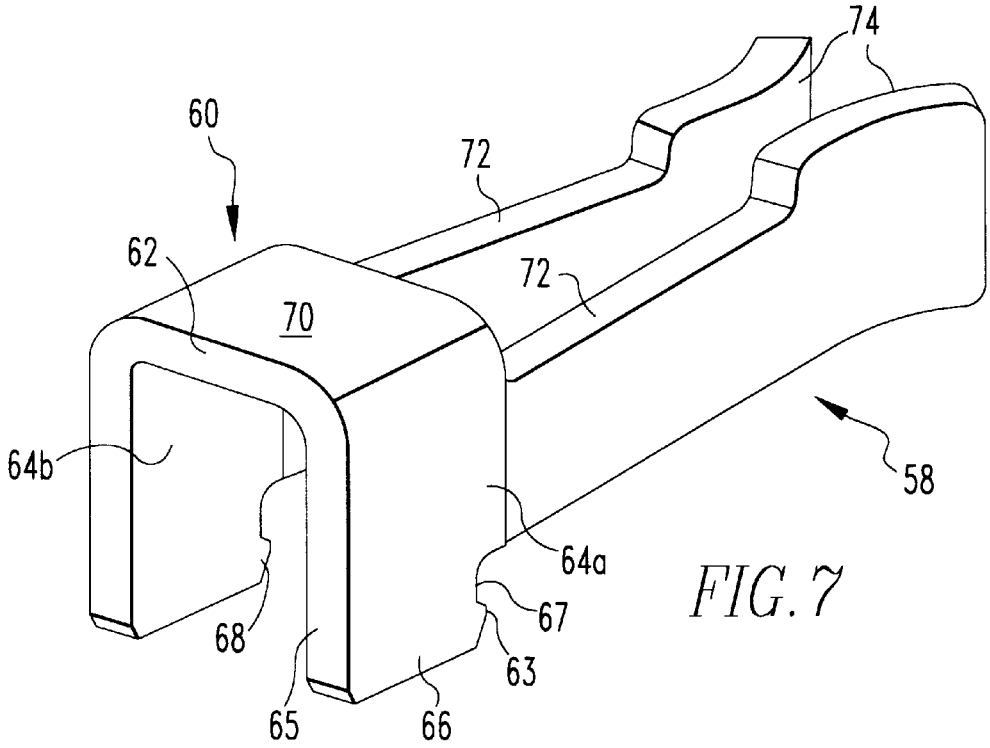
FIG. 7 is an isometric view of a contact terminal used in the connector illustrated in FIG. 1.

FIG. 7 is an enlarged view showing a typical receptacle terminal 58. The terminal preferable includes a generally U-shaped base/securing section 60 having a generally flat base member 62 and two opposed arms 64*a* and 64*b* extending from each end of the base 62. Each arm 64*a* and 64*b* includes a distal mounting portion 66. Each distal mounting portion is bounded by a rear edge 65 and a front edge 67. Preferably a retention element, such as a barb 68, is carried on one or both of the edge surfaces 65 and 67. The bottom surface 70 of the base 62 is preferably flat and is plated or prepared in a manner that is receptive to solder. A pair of cantilever beams 72 extends from the base section 66 and carry opposed contact surfaces 74 that are adapted to engage a mating pin. The terminal 58 is preferably formed as a one piece stamping of suitable electrical terminal material, such as beryllium copper alloys and phosphor bronze alloys.

Figure 8:
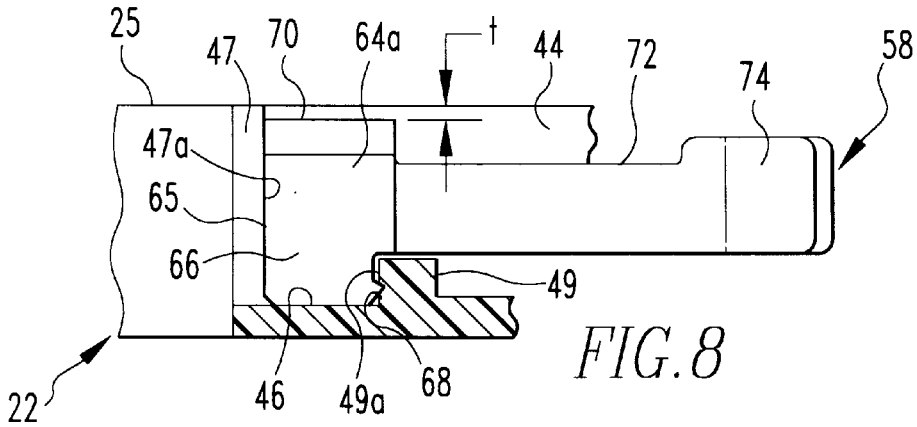
FIG. 8 is a side elevational view, partially in cross-section, of the terminal shown in FIG. 7 mounted in a terminal cavity.

FIG. 8 illustrates the manner in which a terminal 58 is secured into a terminal cavity 44. The back end of the cavity includes a pair of end walls 47 and an intermediate retaining wall 49. The distance between the front surface 47*a* of each wall 47 and the rear surface 49*a* of the retaining wall 49 is substantially equal to the length, in the longitudinal direction of cavity 44, of the distal portion 66 of each terminal arm so that the distal portion 66 is received in an interference fit relationship in the slot 46 formed between front surface 47*a* and rear surface 49*a*. The retention barbs 68 engage the surfaces 49*a* of the retaining walls 49 for additional securing of the terminal 58 in the cavity 44.

The terminal 58 is retained in the frame 22 in a manner such that the surface 70 of the terminal is either coplanar with or spaced slightly by a distance t (FIG. 8)from the support plane formed by the supporting surfaces 25, such surfaces generally comprising the shoulder surface 42 and the top surfaces of the walls between cavities 44 and cavities 48. Such positioning is desirable to accommodate the presence of an adequate amount of solder paste disposed between the surfaces 70 and the facing surface of the circuit substrate 36. A complete connected module 20 is made by inserting a plurality of terminals 58 into terminal cavities 44. A quantity of solder paste is applied to the circuit substrate 36 by conventional means, such as through a solder mask. Then, the circuit substrate 36 is pressed onto the frame 22 and is held into position by the peg 38 and lugs 40. Thereafter, the assembly comprising the frame 22, circuit substrate 36 and terminals 58 undergoes a re-flow operation to effect a solder connection between the terminals 58 and contact pads (not shown) at the front ends of circuit traces T (FIG. 9) of the circuit substrate 36. Such an assembly can then be affixed to cables to form a cable assembly by soldering the stripped portions R of wires W (FIG. 1) to contact pads (not shown) at the rear ends of tracks T.

Figure 9:
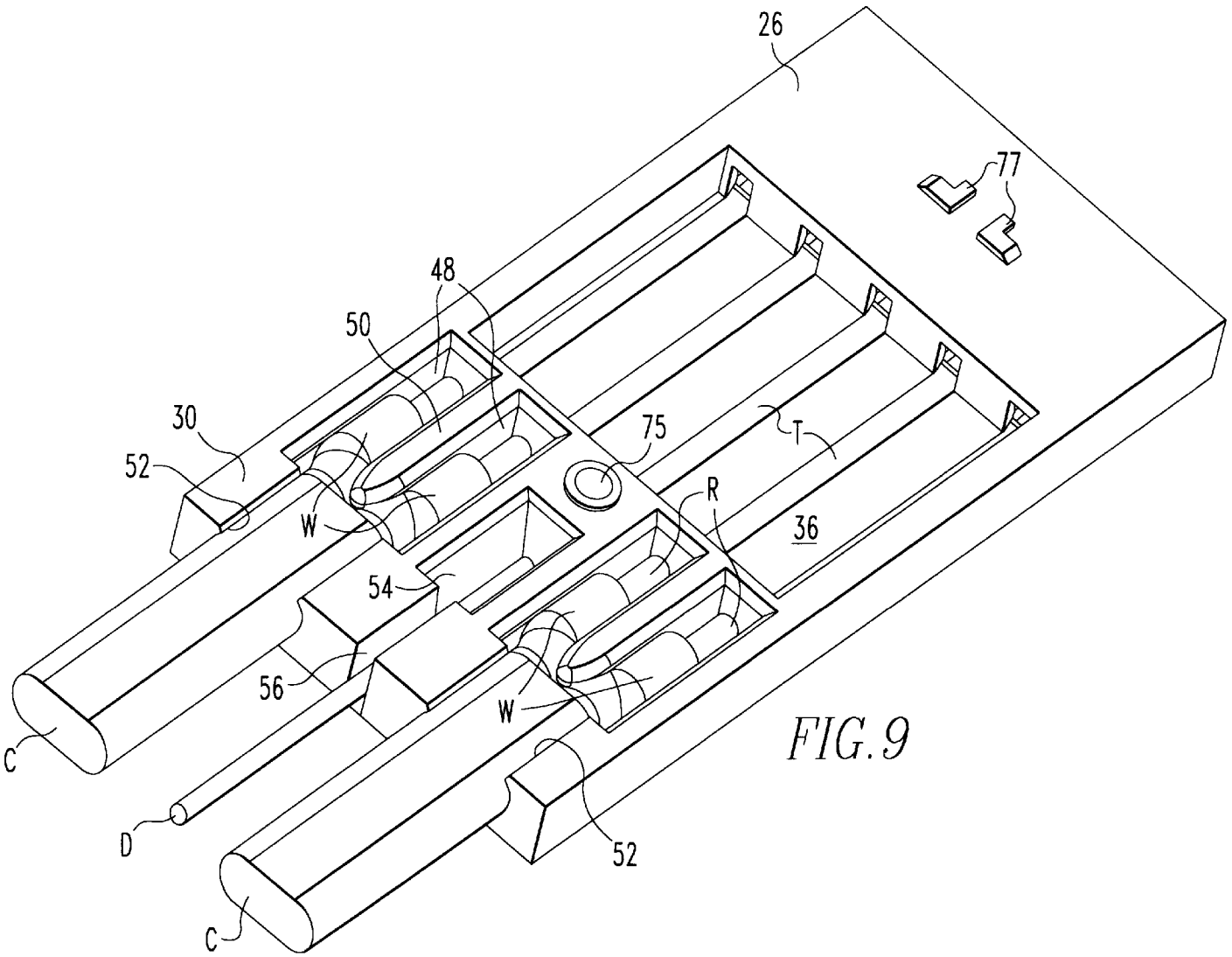
FIG. 9 is an isometric view of the opposite side of the connector shown in FIG. 1.

Such a cable assembly is illustrated in FIG. 9. As shown, each of the conductors or wires W from one of the cables C is positioned in one of the wire cavities 48 by inserting the cable end through an opening 52 in the end member 30. Each of the wires W is arranged on one or the other side of wall 50. The stripped ends of wires R are positioned over appropriate contact pads formed at the ends of circuit traces T on the circuit substrate 36. By reason of the fact that the cavities 48 are open to the major surface 26, there is ready access to the wires W for purposes of soldering, welding or otherwise securing such conductors to the circuit traces T. If a drain wire D is present, in a similar fashion it is introduced into an appropriate cavity 54 through grove 56. The cavity 54 provides access for soldering or otherwise affixing the drain wire D to an appropriate trace on the circuit substrate 36. The surface 26 of the frame 22 is provided with locating features, such as the circular boss 75 (FIG. 9) and locating lugs 77. The boss 75 is sized and positioned to engage the peg 38 of an adjacent stacked module and the locating lugs 77 are sized and positioned to receive and locate the lugs 44 of an adjacent stacked module, thereby facilitating alignment of the modules 20. The module to module terminal pitch distance, for example 2 mm to match the 2 mm centerline pitch between adjacent columns of a pin header, be regulated by the axial length of post 38 and the height of lugs 40 and/or the height of boss 75 and lugs 77. As a result, these elements may create a stand-off distance or air gap between adjacent stacked modules, that can influence impedance of the connector.

Figure 10:
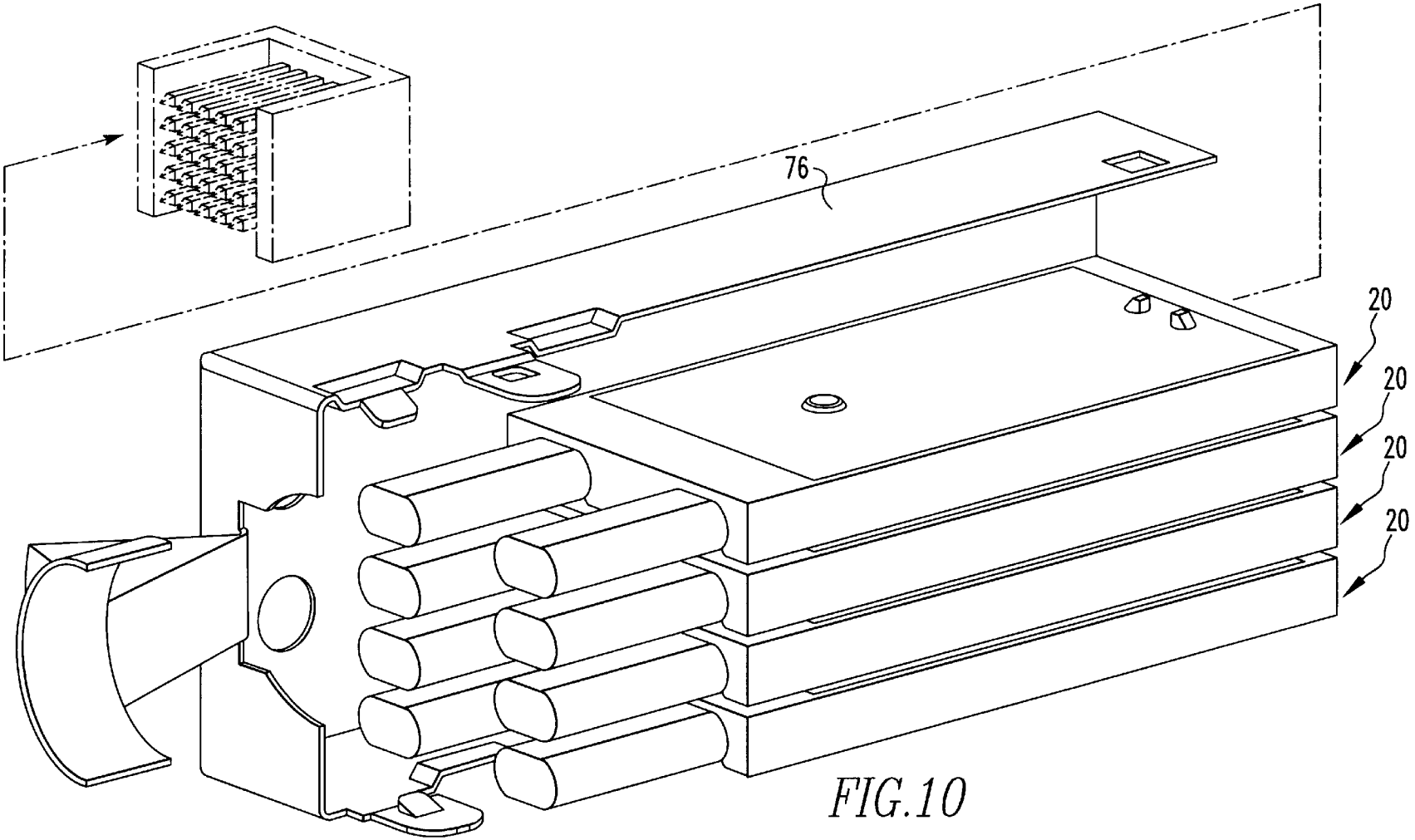
FIG. 10 is an isometric view of a partially assembled modular cable connector using a plurality of modules of the type shown in FIG. 1.

Referring to FIG. 10, a multi-conductor shielded cable connector can be formed by stacking a plurality of modules 20 and enclosing the stack within mating halves 76 of a shield. Such mating shields of this type have previously been described in published PCT Patent Application W097/47058 filed in the name of the assignee of this application (the disclosure of which is incorporated herein by reference) and in co-pending U.S. patent application Ser. No. 08/941824 filed Oct. 1, 1997 and U.S. patent application 09/041917 filed Mar. 12, 1998, both of which are owned by the assignee of this application and both of which are incorporated herein by reference.

Figure 11:
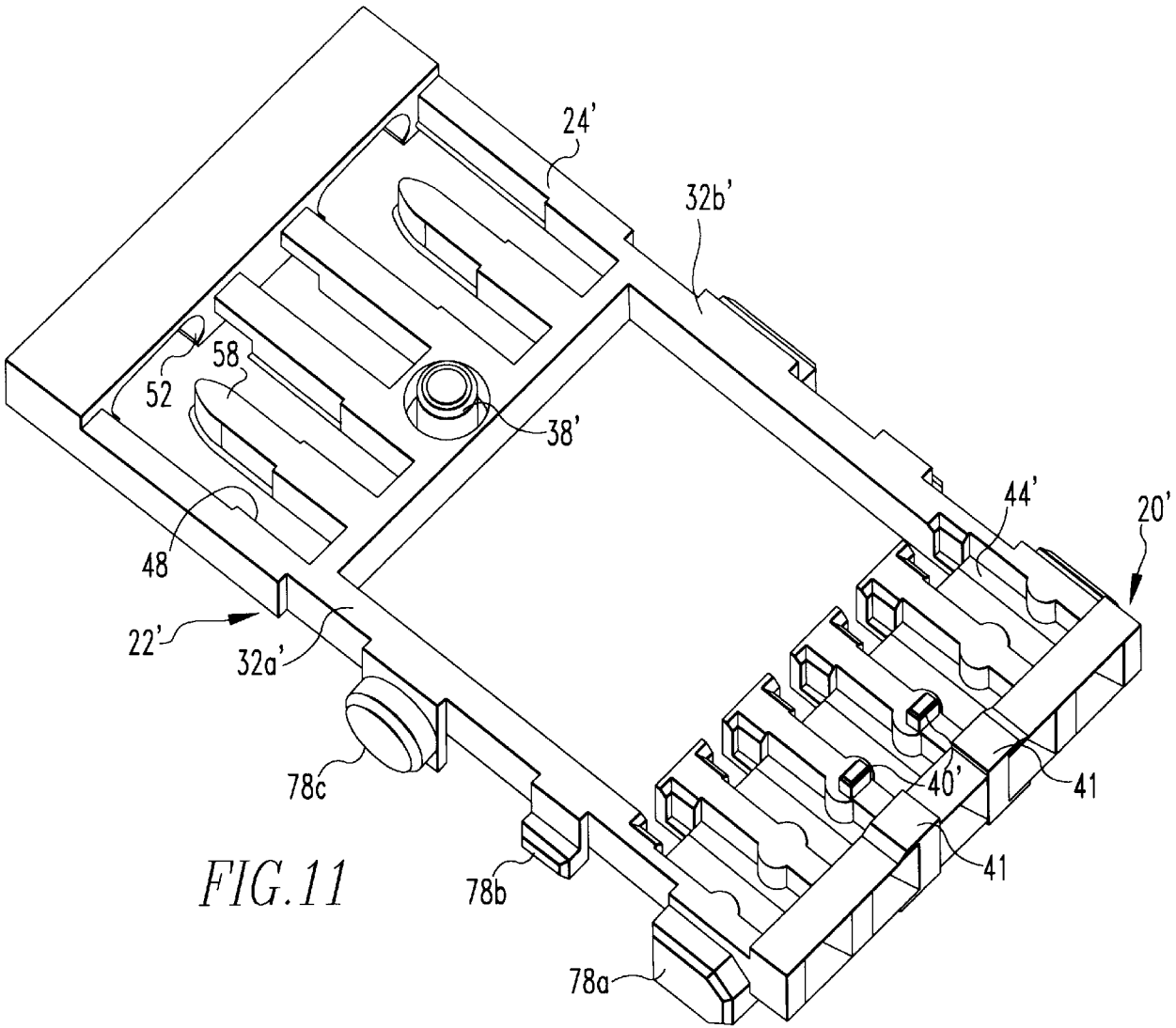
FIG. 11 is an isometric view of a second embodiment of cable connector frame.
Figure 12:
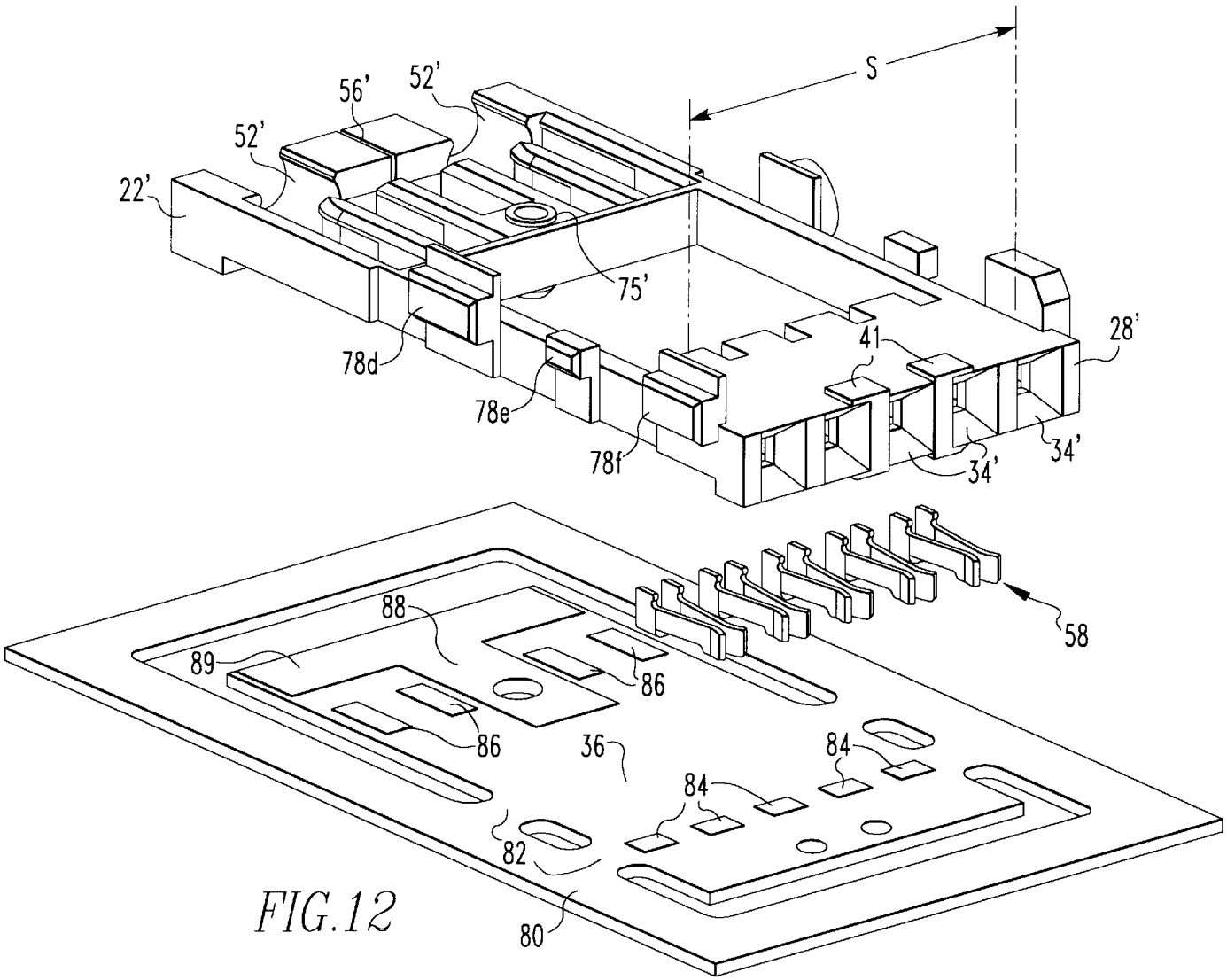
FIG. 12 is an exploded isometric view showing an assembly of elements utilizing the frame of FIG. 11.

In FIGS. 11, 12, 13 and 14, a second embodiment of connector module 20' is illustrated. Referring to FIG. 11, the frame or body member 22' has many of the features of the frame 22 previously described. It differs primarily in the addition of locating/guidance bodies 78*a*, 78*b* and 78*c* formed on side member 32*a'* and locating/guidance members 78*d*, 78*e* and 78*f* formed on side member 32*b'* (FIG. 12). The members 78*a*–*d* primarily provide a means for locating the modules in correct orientation in a shield, such as shield 76, and provide guidance structures extending beyond the shield for guiding a cable connector into a mating header, as described in the patent applications identified in the previous paragraph.

The bodies 78*a*–78*d* are arranged so that the distance S (FIG. 12) is just slightly greater than the width of module 20. Thus module 20 as shown in the previous embodiment, can be located and aligned in stacked relation to a module 20' formed from the frame member 22'. Terminal pitch between modules can be controlled by the height of boss 75' and standoffs 41' (FIG. 12).

Figure 13:
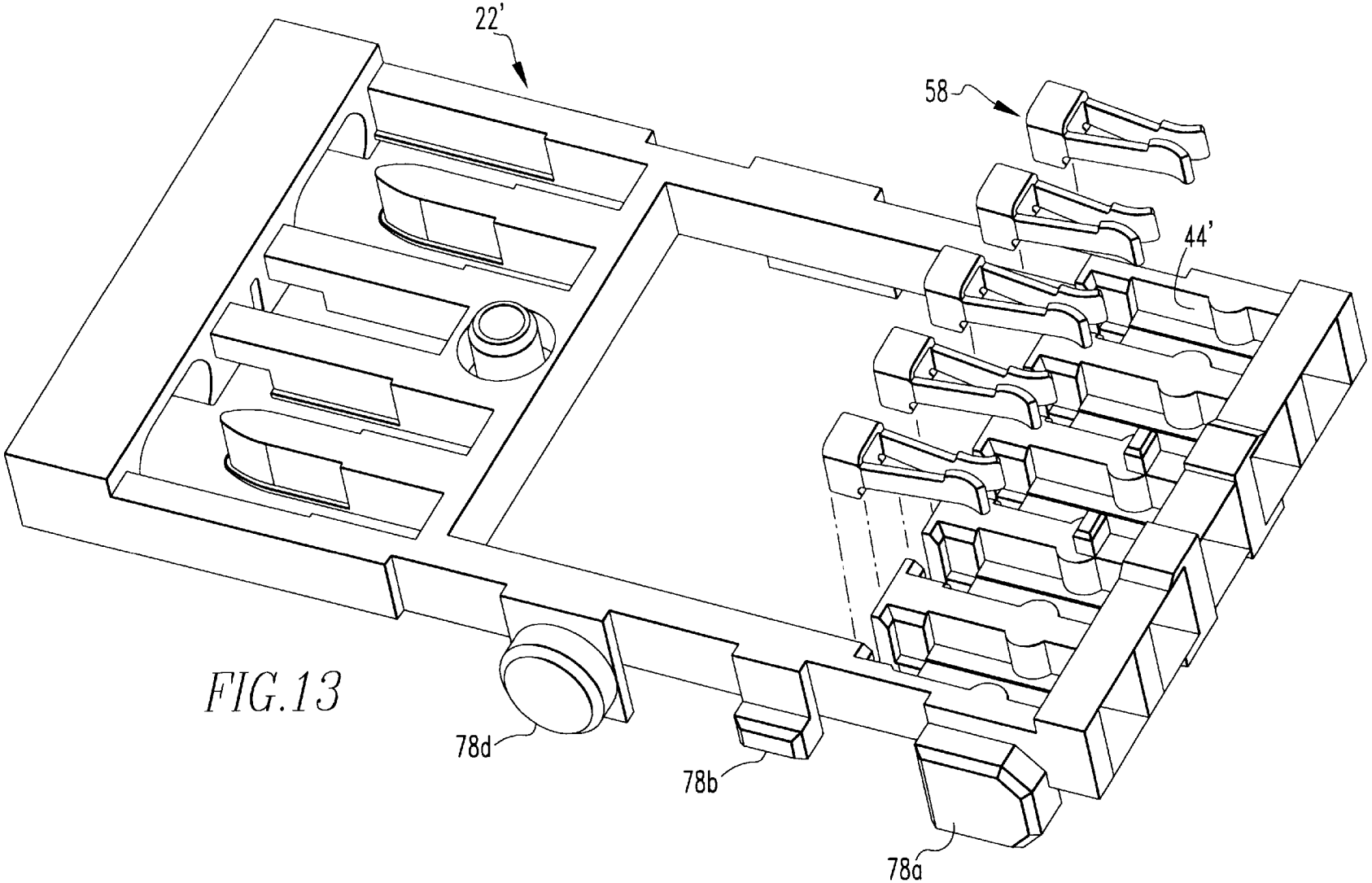
FIG. 13 is an isometric view showing the insertion of terminals into the frame of FIG. 11.

As illustrated in FIGS. 12 and 13, the terminals 58 are inserted into terminal cavities 44' and are retained therein by structure as illustrated in the previous embodiment. Once the assembly of the frame 22' and terminals 58 is completed, that assembly is associated with a circuit substrate 36. Under preferred manufacturing conditions, the individual circuit substrates 36 are formed in multiples from a larger sheet represented by the numeral 80. The individual substrates 36 are held in the larger sheet by narrow bridging elements 82 that are designed to be easily ruptured. Each of the substrates includes terminal contact pads 84 and wire contact pads 86 formed at each end of continuous circuit traces (not shown). Substrate 86 also includes a ground contact pad 88 that includes a generally width-wise extending portion 89. The ground pad 88 may have a ground wire, if present, soldered to it. Also, shields, if present in the cables C, can be soldered or otherwise electrically associated with the width-wise extending portion 89. The ground pad 88 may be connected to a ground plane (not shown) formed within the circuit substrate 36. A connector module is assembled in the manner previously described, using a preferred technique of applying solder paste through a mask to the terminal contact pads 84. The assembly comprising the frame 22' and terminals 58 is then pressed onto the circuit substrate and the resulting assembly thereafter undergoes a reflow operation to solder the terminals onto circuit substrate 36.

Figure 14:
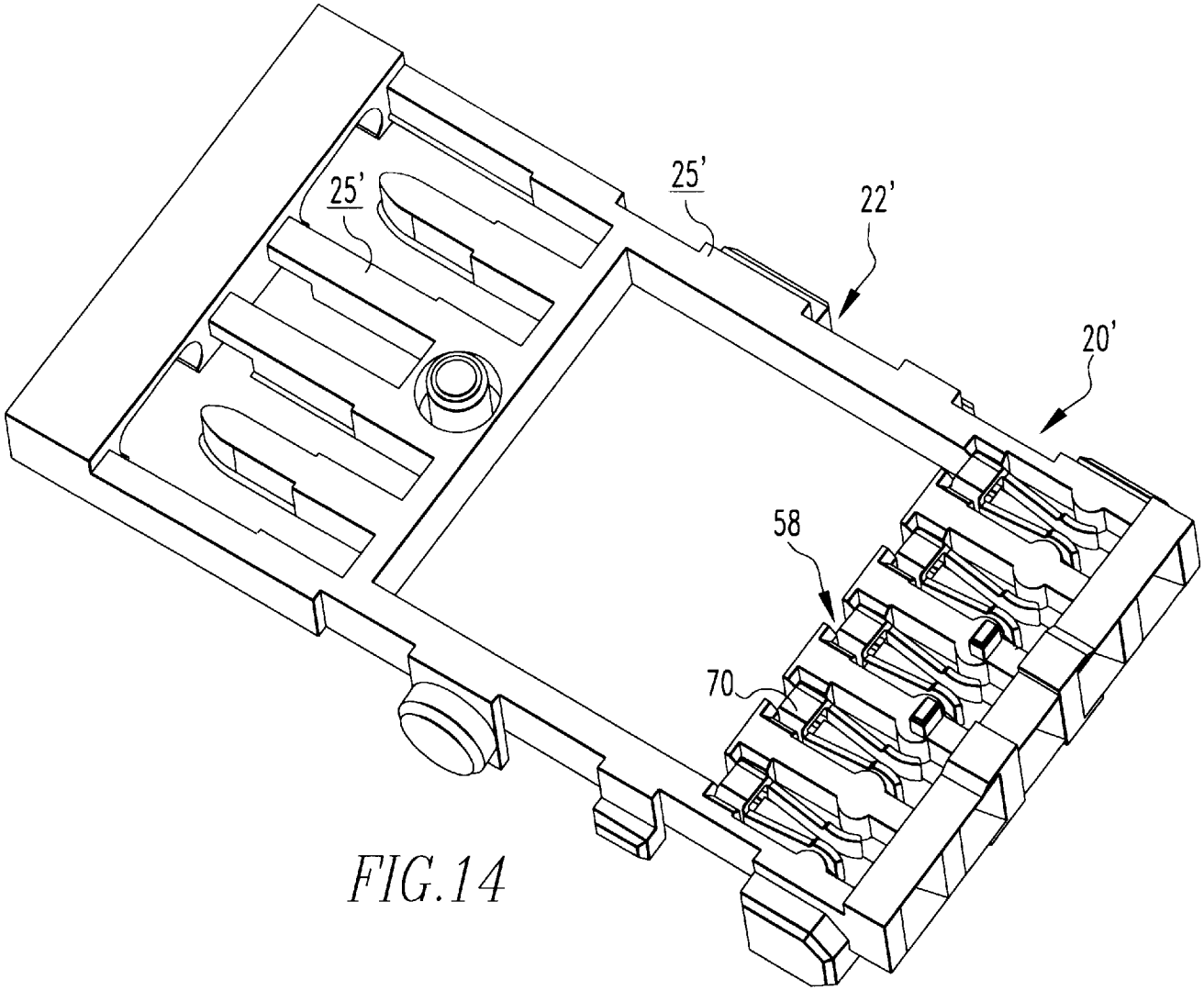
FIG. 14 is an isometric view of the assembly shown in FIG. 13 with terminals retained in the frame.
Figure 15:
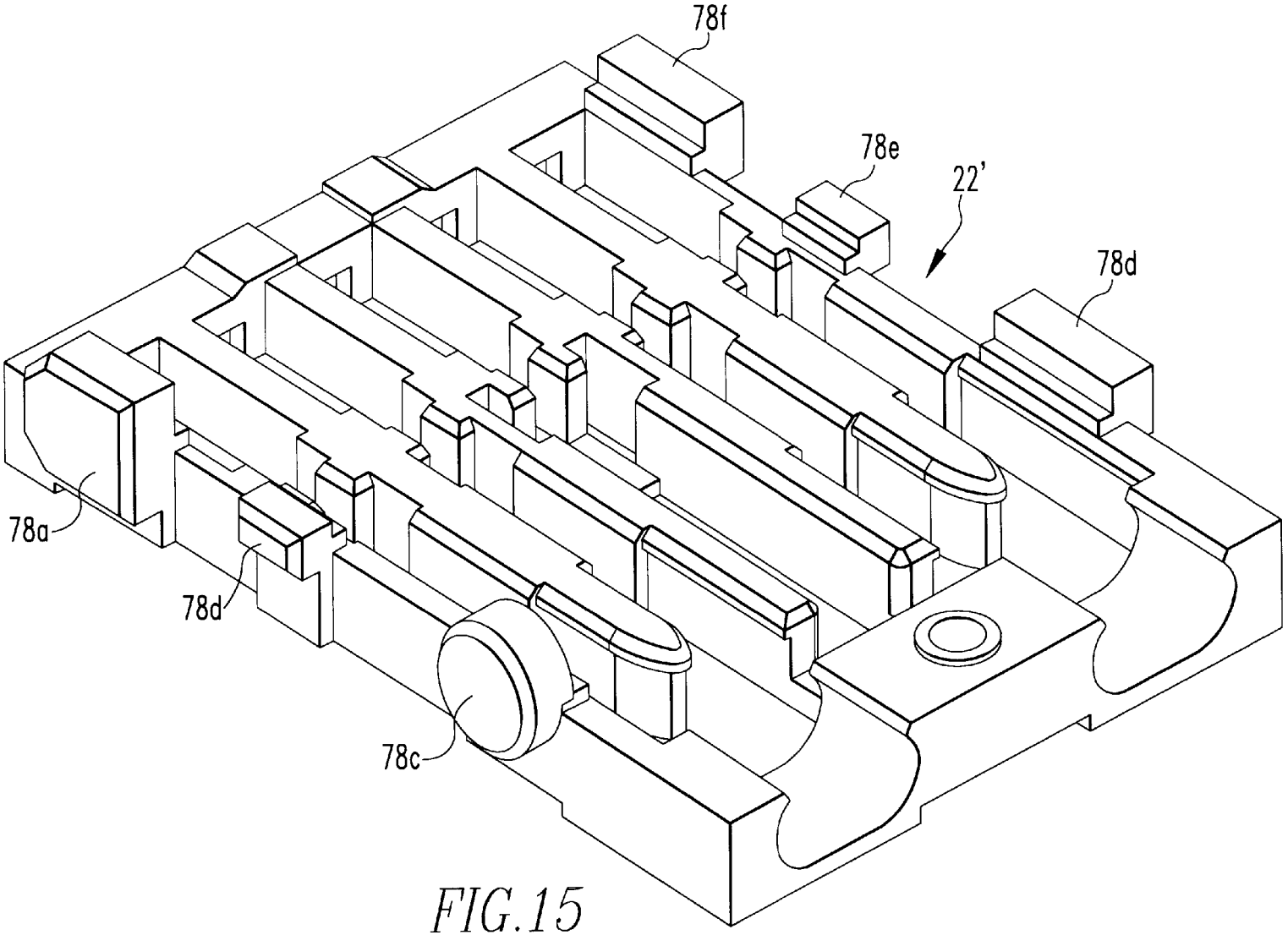
FIG. 15 is an isometric view of the opposite side of the frame shown in FIG. 11.

As in the previous embodiment, the frame 22' includes openings 52' and 56' for the cables and drain wire, as previously described. As shown in FIG. 14, the terminals 58 are assembled in the frame 22' with the solder receiving surfaces 70 of the terminals coplanar or slightly spaced from the plane formed by the surfaces 25'.

Figure 16:
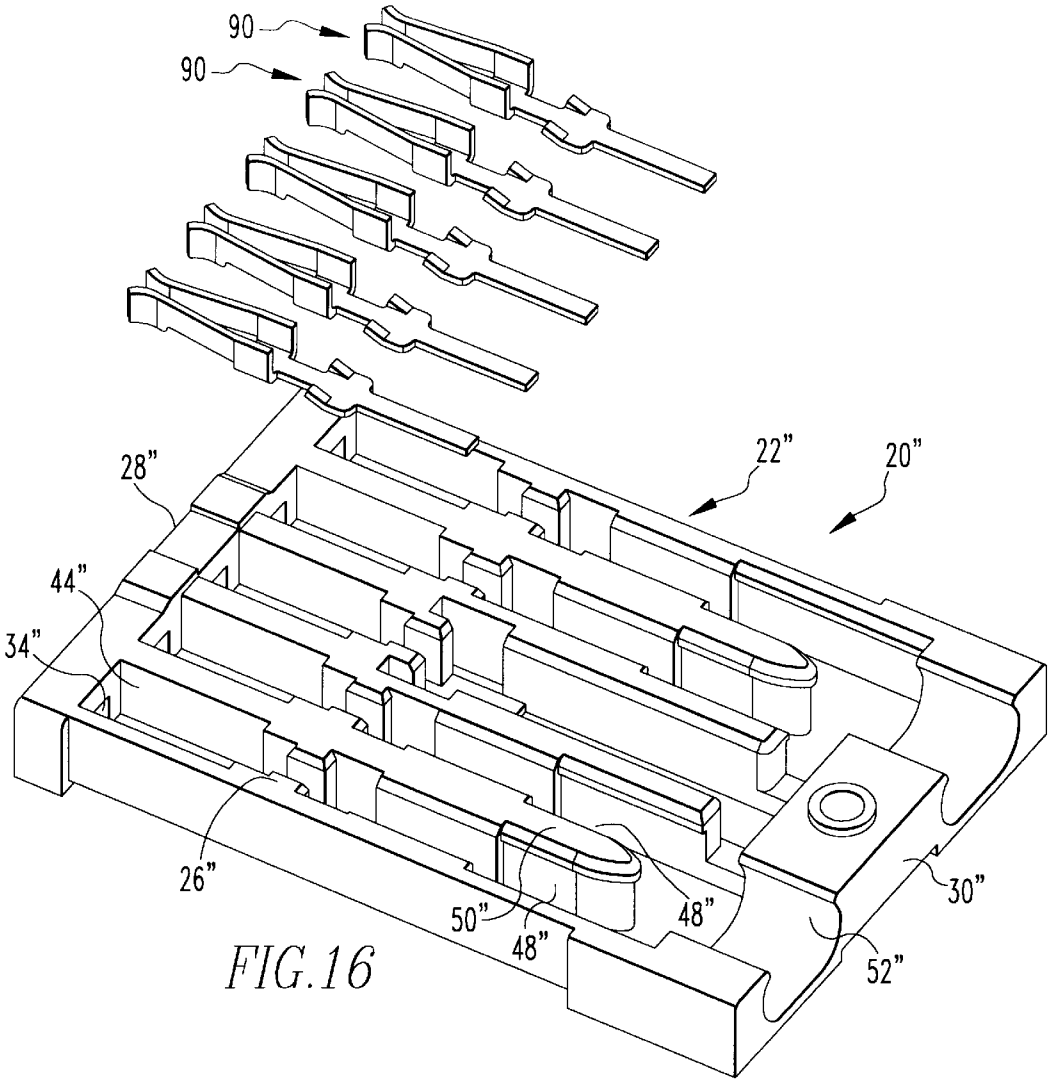
FIG. 16 is an exploded isometric view of a third embodiment of the invention.
Figure 17:
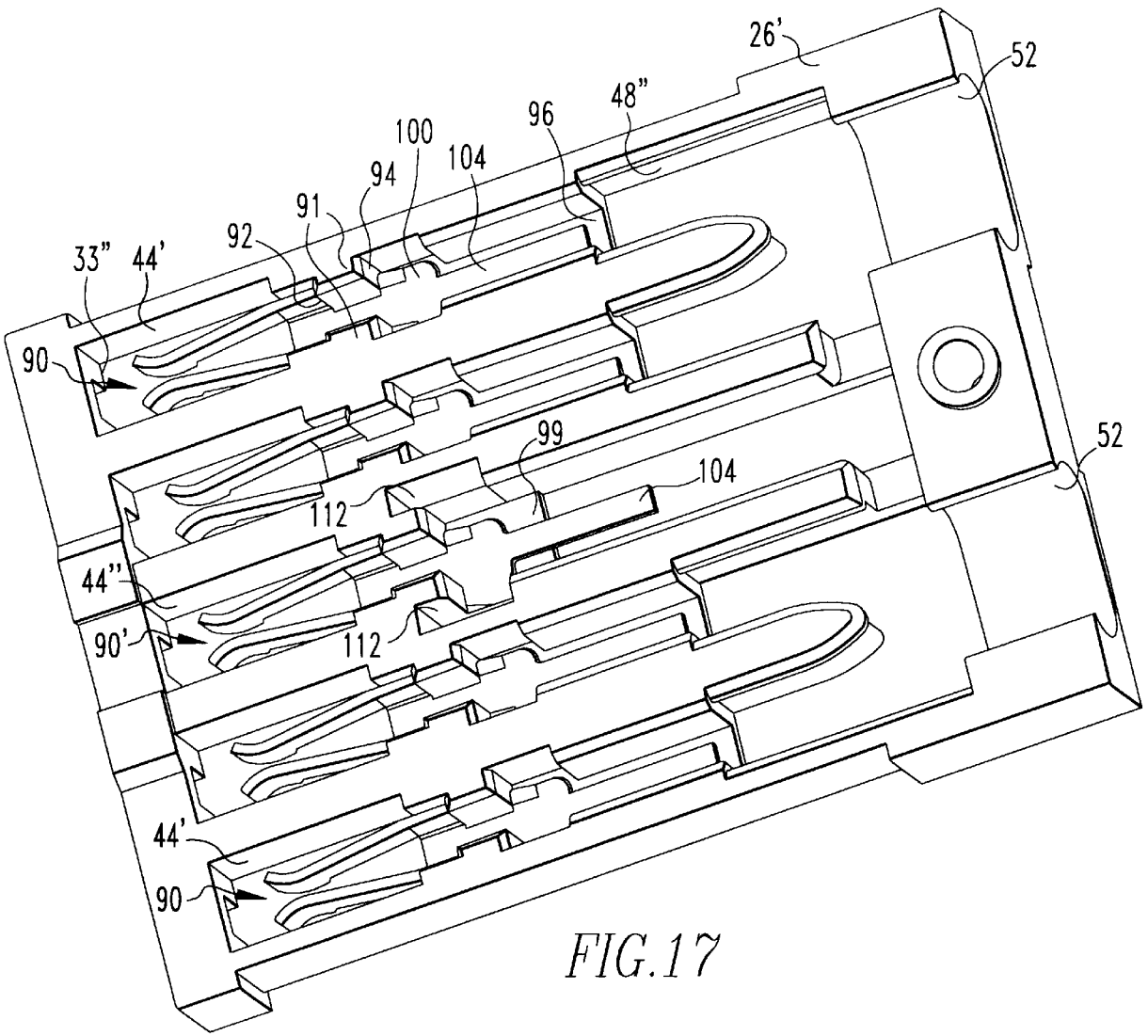
FIG. 17 is an isometric view of the assembly formed from the parts shown in FIG. 16.
Figure 18:
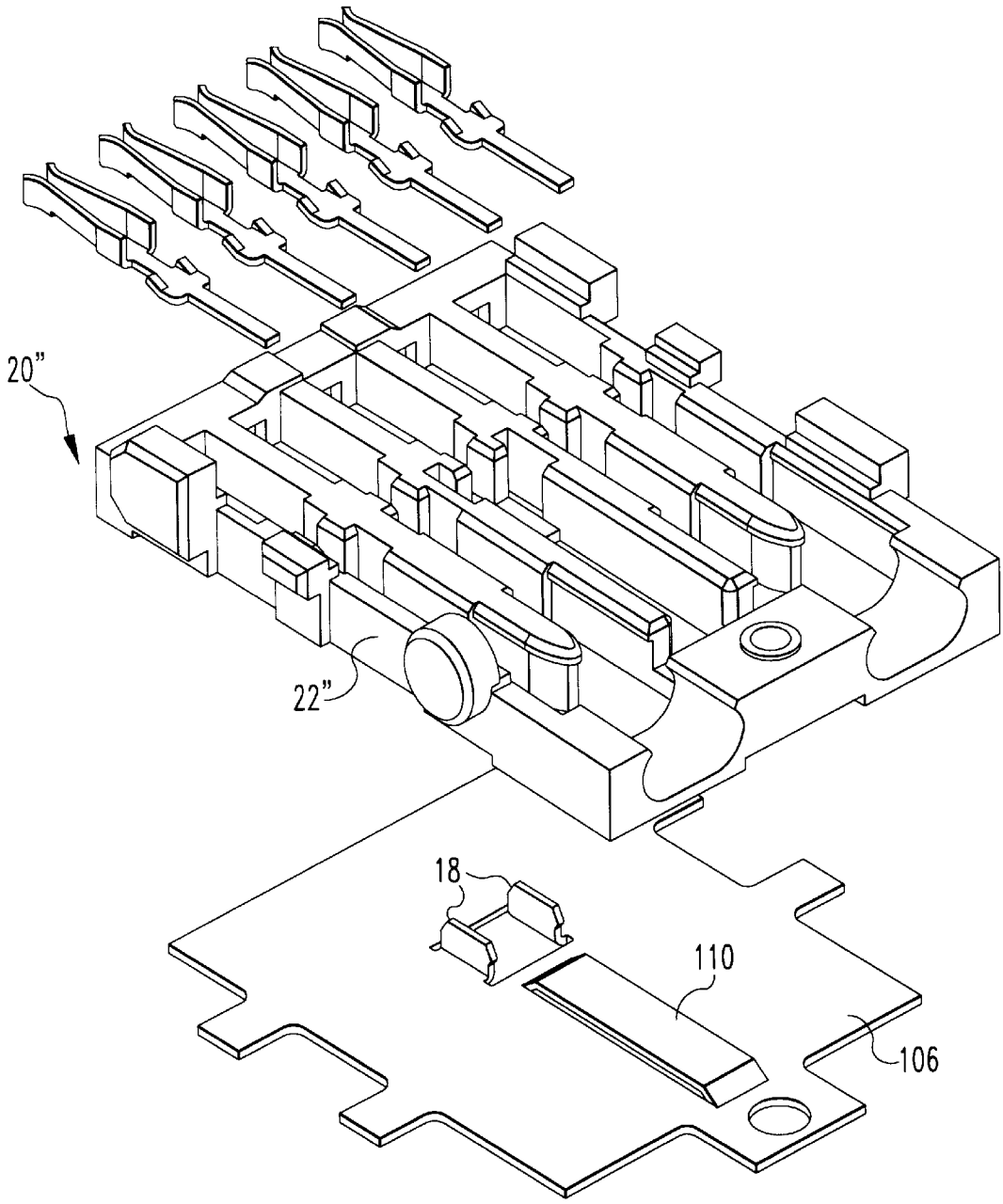
FIG. 18 is an exploded isometric view of the elements depicted in FIG. 16 and a shield plate.
Figure 21:
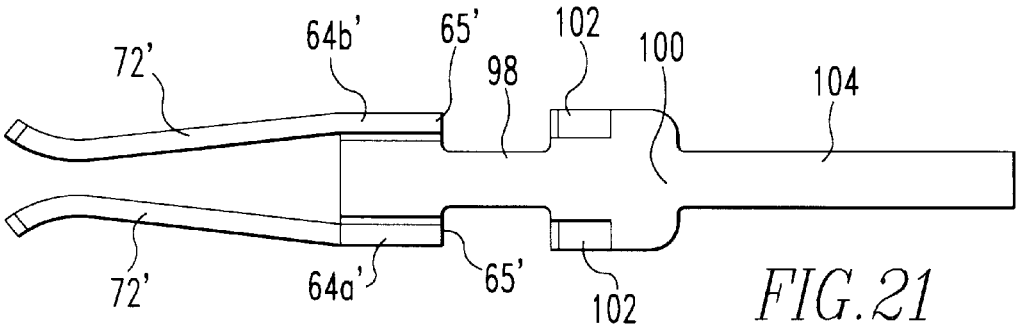
FIG. 21 is a top plan view of the terminal illustrated in FIGS. 19 and 20.
Figure 20:
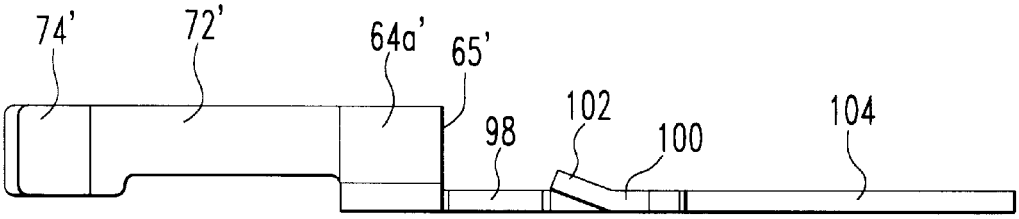
FIG. 20 is a side elevational view of the terminal shown in FIG. 19.
Figure 19:
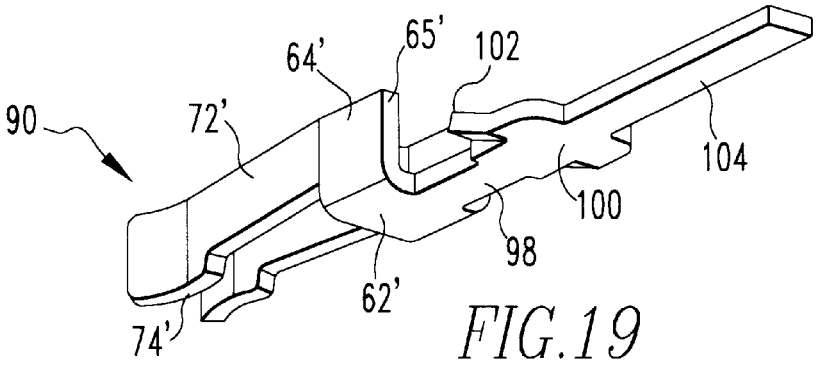
FIG. 19 is an isometric view of a terminal used in the embodiment illustrated in FIGS. 16–18.

FIGS. 16–18 illustrate a third embodiment of connector module 20". This embodiment differs from the previous embodiments by eliminating the need for the circuit substrate 36, 36'. In this embodiment, the frame 22" includes a plurality of terminal receiving cavities 44' that communicate with pin receiving openings 34". The contact terminals 90 are inserted into the cavities 44" through the major surface 26" that is opposite to the major surface 24 and 24' of the previous embodiments. As in previous embodiments, the end member 30" includes cable receiving openings 52' for receiving cables in cable receiving cavities 48" that are formed on each side of separating walls 50". The cavities 44" differ from those previously described by having a pair of flanking terminal securing walls 91 formed in each cavity (FIG. 17). The walls 91 each have a forwardly disposed surface 92 and a rearwardly disposed surface 94. In addition, the cavities 44" extend rearwardly and have a floor section 96 extending to the wire receiving cavities 48". Referring to FIGS. 19, 20 and 21, each terminal 90 includes a U-shaped base section having a transverse base 62' and a pair of upstanding arms **64*a*' and 64*b*' as previously described. Cantilever beams 72' extend forwardly from the arms 64*a*', 64*b*' and carry contact sections 74' for engaging a pin. Each of the terminals 90 includes a rearwardly extending neck portion 98 and a securing plate 100 having laterally extending portions. The laterally extending portions include locking tabs 102 that preferably are lanced from plate 100. A terminal tail portion 104 extends from the plate 100. The base 62', neck 98 plate 100 and tail portion 104** preferably are substantially coplanar and colinear.

As illustrated in FIG. 17, the terminals 90 are pressed into the cavities 44'. The terminals 90 are retained by an interference fit formed between the surfaces 92 and 94 of the securing walls 91 and the rear edge surfaces 65 and forward surfaces of the locking tabs 102. As shown in FIG. 17, the two pairs of outer terminals 90 are each positioned with the securing base 100 and tail 104 resting on the floor 96 of the cavity. Wires are inserted into the wire cavities 48" with insulation stripped portions overlying the tail portions 104. Attachment of the wires to the tail portions by soldering, welding, conductive adhesives or other means, such as IDC connections, crimping etc. can readily be achieved through open major side 26'.

In this embodiment, the centrally disposed terminal 90' is meant to function as a ground terminal. In this case, the cavity 44" receiving the terminal 90' has a shorter floor section 99 so that the tail portion 104 extends beyond the floor for purposes as will be later described.

Referring to FIG. 18, this third embodiment can include a shield plate 106 disposed on one side of the module. The shield plate 106 includes a pair of upstanding, preferably barbed retaining tangs 108. The retaining tangs 108 are received in slots 112 (FIG. 17) and retained therein by an interference fit, thereby holding the shield onto the frame 22". As shown in FIG. 18 the shield 106 also includes a raised contact portion 110. When the shield is fixed onto the frame 22', the contact member 110 engages the underside of the tail section 104 of the ground terminal 90', thereby establishing an electrical connection between the ground terminal 90' and shield. As with previous embodiments, provision can also be made for ground wires and shielding braids to be attached to the shield 106.

Figure 22:
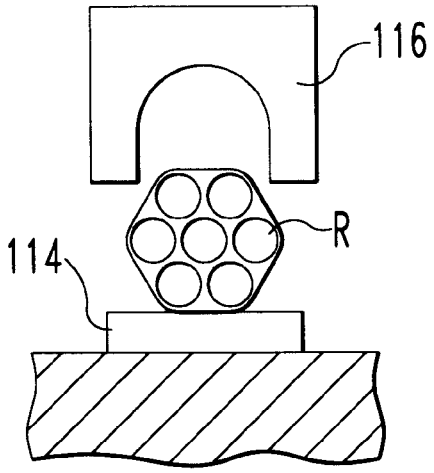
FIGS. 22 and 23 are cross-sectional views illustrating attachment of wires to circuit substrates.
Figure 23:
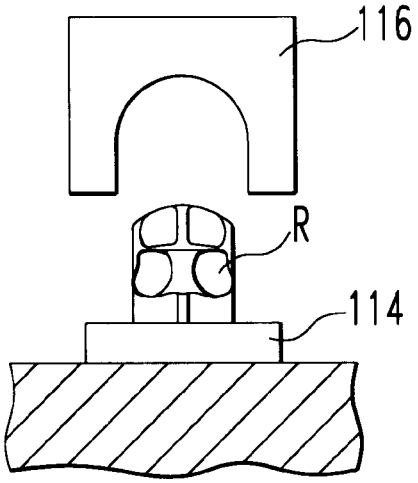

As previously described and with reference to FIGS. 22 and 23, the stripped portions R of wires W are affixed to contact pads 114 of the traces by suitable means. One particular means that has been found particularly useful is to pre-tin the strands of the wires w and then solder them onto the pads 114 by means of an appropriately shaped tool 116, that essentially comprises a heated electrode. Of course, other means may be utilized for soldering, welding or otherwise electrically and mechanically fixing the wires W onto the contact pads 114.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. An electrical connector comprising:

(a) an insulative body having opposed first and second major surfaces and a plurality of edge members extending between the major surfaces that define a peripheral extent; said body having a mating interface formed along one of the edge members, said mating interface being adapted to mate with a mating connector, the mating interface having at least one inwardly extending opening extending along a mating direction of the connector, said body having a terminal receiving cavity formed in the body and extending from at least one of the first or second major surfaces of the housing into communication with said opening said cavity defining an insertion direction for a terminal;

(b) an electrically conductive terminal insertable into the cavity along said insertion direction, said insertion direction being transverse to said mating direction, and retaining structure formed on the terminal for cooperating with the terminal receiving cavity to retain the terminal in the cavity;

(c) a conductor receiving structure formed in the insulative body at a location spaced from said mating interface for receiving a flexible conductor adapted to be terminated by said electrical connector; and an access opening in the insulative body to allow access to an end portion of the conductor into an interior portion of said body; and (d) a circuit substrate having a peripheral extent smaller than said peripheral extent of said body and adapted to be mounted on one of the opposed major surfaces.

2. An electrical connector as in claim 1, wherein the circuit substrate having electrically conductive traces extending between the terminal receiving cavity and the access opening; and the terminal including a substrate mounting portion for mounting the terminal on the circuit substrate.

3. An electrical connector as in claim 2, and further comprising a electrically conductive shield member received on a major surface of the insulative body opposite the circuit substrate.

4. An electrical connector as in claim 1, wherein the terminal includes a conductor securing section extending to the access opening for receiving said end portion of the conductor.

5. An electrical connector as in claim 4, and further comprising and electrically conductive shield member mounted on one of major surfaces of the insulative body.

6. An electrical connector comprising:

(a) a housing of insulative material formed in a generally frame-like manner having two opposed end members joined by two opposing side members, one of the end members defining a mating interface along which the connector is mated with a mating connector by movement in a mating direction, said end and side members being arranged to form opposed major surfaces of the body;

(b) a plurality of terminal receiving cavities formed adjacent the end member forming the mating interface; each cavity having terminal retention guides extending from a first of the major surfaces toward the other major surface;

(c) a plurality of electrically conductive terminals, each terminal having a mounting portion for being received in said retention guides, each mounting portion including a locking element for securing the terminal in the retention guides, and a base surface adapted to be disposed along said first major surface; and (d) a retention structure extending from said housing and adapted to engage a circuit substrate to which said terminals mount.

7. An electrical connector comprising:

(a) a circuit substrate having at least one circuit trace, said circuit trace having first and second spaced contact regions;

(b) a frame mounted on the circuit substrate, the frame having: an edge defining a mating interface for association with a mating connector; a terminal receiving cavity in the frame adjacent said mating interface, the terminal receiving cavity having a portion aligned with a first of said contact regions; and a recess sized to receive said circuit substrate;

(c) an electrically conductive terminal receivable in said terminal receiving cavity, said terminal having a mounting section positionable adjacent said contact portion; and (d) a conductor receiving cavity in the frame spaced from said terminal receiving cavity, the conductor receiving cavity being aligned with a second of said contact regions.

8. Connector as in claim 7, and further comprising a shield overlying a side of the frame opposite the circuit substrate.

9. A connector as in claim 7, wherein the frame includes an edge spaced from the mating interface, said spaced edge having an opening for receiving a conductor, said opening being in communication with said conductor receiving cavity.

10. A connector terminal comprising:

(a) a generally U-shaped box section including a base and two opposed arms extending in facing relationship from opposite ends of the base, (b) a pair of opposed cantilever beams, each extending from a medial portion of one of the arms in a direction array from the base, and (c) a retention section formed on a distal portion of at least one of the arms for securing the terminal in an insulative housing.

11. A connector terminal comprising:

(a) a generally U-shaped box section having a base and two opposed arms extending in facing relationship from opposed ends of the bases;

(b) a pair of opposed cantilever beams, each extending from one of the arms;

(c) a neck section extending from the base in a direction opposite to the beams and having side edges;

(d) a securing plate integral with the neck section and having portions disposed laterally beyond the side edges of the neck section, whereby rear edges of the arms disposed opposite the cantilever beams and the portions of the receiving plates extending laterally beyond the side edges of the neck form a post receiving slot.

12. A terminal as in claim 11, wherein locking elements are disposed on at least one of said rear edges and said laterally extending portions for securing the terminal in a housing.

13. A terminal as in claim 12, and further comprising a conductor receiving tail portion extending from the securing plate.

14. A terminal as in claim 12, wherein the base, the neck and the securing plate are substantially colinear.

15. A method of making a connector comprising:

(a) providing a circuit substrate having at least one conductive trace;

(b) providing an insulating frame having a first cavity, a second cavity and a recess;

(c) inserting and retaining a terminal in the first cavity;

(d) mounting the circuit substrate in the recess on the frame with a first portion of the conductive trace adjacent the terminal and a second portion of the trace adjacent the second cavity; and (e) establishing an electrical connection between the terminal and the conductive trace.

16. The electrical connector as recited in claim 6, further comprising a circuit substrate mountable to said housing.

17. The electrical connector as recited in claim 16, wherein said circuit substrate has an aperture that receives said retention structure of said housing.

18. The electrical connector as recited in claim 16, wherein said housing further comprises a recess, said recess receiving said circuit substrate.

* * * * *